US011709012B2

(12) United States Patent
Park et al.

(10) Patent No.: US 11,709,012 B2
(45) Date of Patent: Jul. 25, 2023

(54) REFRIGERATOR

(71) Applicant: SAMSUNG ELECTRONICS CO., LTD., Suwon-si (KR)

(72) Inventors: Chanbin Park, Suwon-si (KR); Yang-Yeol Gu, Suwon-si (KR); Jaejin Lee, Suwon-si (KR); Jeonghyun Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/744,330

(22) Filed: May 13, 2022

(65) Prior Publication Data

US 2022/0268510 A1 Aug. 25, 2022

Related U.S. Application Data

(63) Continuation of application No. 16/876,685, filed on May 18, 2020, now Pat. No. 11,359,856.

(30) Foreign Application Priority Data

May 17, 2019 (KR) ..... 10-2019-0058414

(51) Int. Cl.
*F25D 23/02* (2006.01)
*E05B 65/00* (2006.01)

(52) U.S. Cl.
CPC ..... *F25D 23/028* (2013.01); *E05B 65/0042* (2013.01); *F25D 23/025* (2013.01); *E05Y 2800/71* (2013.01); *E05Y 2900/31* (2013.01)

(58) Field of Classification Search
CPC ..... F25D 23/028; F25D 23/025; F25D 2323/021; F25D 11/02; F25D 2201/30; F25D 2323/02; E05B 65/0042; E05Y 2800/71; E05Y 2900/31; E05C 7/04
See application file for complete search history.

(56) References Cited

U.S. PATENT DOCUMENTS 9,234,695 B1 1/2016 Dubina et al.
10,837,695 B2 * 11/2020 Baum ..... B67D 1/0857
10,982,897 B2 * 4/2021 Reuter ..... F25D 23/087
(Continued)

FOREIGN PATENT DOCUMENTS

CN 201589488 9/2010
JP 5-256559 10/1993
(Continued)

OTHER PUBLICATIONS

Extended European Search Report dated Oct. 5, 2020 from European Application No. 20174520.5, 8 pages.
(Continued)

*Primary Examiner* — Hanh V Tran
(74) *Attorney, Agent, or Firm* — Staas & Halsey LLP

(57) ABSTRACT

A refrigerator with an enhanced door includes a main body including a storeroom, first and second doors pivotally coupled to the main body to open or close the storeroom and a pivot bar pivotally installed at the first door. The pivot bar is movable between a first position between the first and second doors and a second position pivoted toward the first door to prevent cold air leaks from the storeroom. A locking device separably locks the pivot bar to the first door when the pivot bar is in the second position.

14 Claims, 11 Drawing Sheets

(56) References Cited

U.S. PATENT DOCUMENTS

| | | | | |
|---|---|---|---|---|
| 11,359,856 | B2 * | 6/2022 | Park | F25D 23/025 |
| 2007/0257589 | A1 * | 11/2007 | Laible | F25D 23/02 312/405 |
| 2008/0000052 | A1 | 1/2008 | Hong et al. | |
| 2009/0273264 | A1 * | 11/2009 | Butler | F25D 23/028 312/405 |
| 2014/0033756 | A1 * | 2/2014 | Kuehl | F25D 23/065 62/272 |
| 2014/0265804 | A1 * | 9/2014 | Wilson | F25D 23/028 312/405 |
| 2016/0018155 | A1 * | 1/2016 | Dubina | F25D 23/028 312/319.2 |
| 2016/0178268 | A1 * | 6/2016 | Jung | E05F 1/10 312/405 |
| 2016/0273827 | A1 * | 9/2016 | Almeida | F25D 23/02 |
| 2017/0234602 | A1 * | 8/2017 | Seo | F25D 23/12 348/151 |
| 2017/0321952 | A1 * | 11/2017 | Jung | F25D 23/04 |
| 2018/0195792 | A1 * | 7/2018 | Segawa | F25D 23/087 |
| 2018/0209209 | A1 * | 7/2018 | Ham | E06B 7/215 |
| 2018/0259244 | A1 | 9/2018 | Kim et al. | |
| 2019/0024964 | A1 * | 1/2019 | Gwon | F25D 23/02 |
| 2019/0024966 | A1 * | 1/2019 | Kim | F25D 23/028 |
| 2019/0049170 | A1 * | 2/2019 | Reuter | F25D 11/02 |
| 2019/0113276 | A1 * | 4/2019 | Ebrom | G03B 17/04 |
| 2019/0368804 | A1 * | 12/2019 | Hwang | F25D 23/028 |
| 2020/0355021 | A1 * | 11/2020 | Dallman | E06B 7/231 |
| 2020/0392776 | A1 * | 12/2020 | Reich | E05B 65/087 |

FOREIGN PATENT DOCUMENTS

| | | |
|---|---|---|
| JP | 11-63800 | 3/1999 |
| JP | 2002-62031 | 2/2002 |
| JP | 2004-176940 | 6/2004 |
| KR | 10-2006-0095419 | 8/2006 |
| KR | 10-2013-0026325 | 3/2013 |
| KR | 10-2013-0052087 | 5/2013 |
| KR | 10-1341569 | 12/2013 |
| KR | 10-2015-0003641 | 1/2015 |
| KR | 10-2015-0003645 | 1/2015 |
| KR | 10-2016-0074188 | 6/2016 |
| KR | 10-2087221 | 3/2020 |
| WO | 2020/200197 A1 | 10/2020 |

OTHER PUBLICATIONS

International Search Report dated Sep. 9, 2020 from International Application No. PCT/KR2020/006052, 3 pages.
Office Action, dated Jul. 21, 2021, in corresponding Chinese Patent Application No. 202010418164.1 (16 pp.).
Chinese Office Action dated Jan. 12, 2022 from Chinese Application No. 202010418164.1.
European Office Action dated Jan. 13, 2022 from European Application No. 20174520.5.
U.S. Office Action dated Jun. 23, 2021 in U.S. Appl. No. 16/876,685.
U.S. Office Action dated Oct. 22, 2021 in U.S. Appl. No. 16/876,685.
U.S. Advisory Action dated Jan. 7, 2022 in U.S. Appl. No. 16/876,685.
U.S. Notice of Allowance dated Feb. 16, 2022 in U.S. Appl. No. 16/876,685.
U.S. Supplemental Notice of Allowability dated Feb. 28, 2022 in U.S. Appl. No. 16/876,685.
U.S. Corrected Notice of Allowability dated Mar. 28, 2022 in U.S. Appl. No. 16/876,685.
U.S. Appl. No. 16/876,685, filed May 18, 2020, Chanbin Park, Samsung Electronics Co., Ltd.
Chinese Office Action dated May 19, 2022 from Chinese Application No. 202010418164.1.
Indian Office Action dated May 2, 2023 for Indian Application No. 202117051937.

* cited by examiner

REFRIGERATOR

CROSS-REFERENCE TO RELATED APPLICATION

This application is a continuation application of U.S. application Ser. No. 16/876,685, filed on May 18, 2020 which is based on and claims priority under 35 U.S.C. § 119 to Korean Patent Application No. 10-2019-0058414, filed on May 17, 2019, in the Korean Intellectual Property Office, the disclosures of each of which are incorporated herein by reference in their entirety.

BACKGROUND

1. Field

The disclosure relates to a refrigerator, and more particularly, to a refrigerator with an enhanced door.

2. Discussion of Related Art

Refrigerators are home appliances having a main body with storerooms and a cold air supply system for supplying cold air into the storerooms, to keep food and groceries fresh. The storerooms include a fridge maintained at temperatures of about 0 to 5 degrees Celsius for keeping foods cool, and freezer maintained at temperatures of about 0 to −30 degrees in Celsius for keeping foods frozen.

The storeroom commonly has an open front through which to take out or receive food, and the open front is opened or closed by a door.

Refrigerators may be classified by types based on the form of storerooms and doors. There may be top mounted freezer (TMF) typed refrigerators in which a storeroom is partitioned by a horizontal partition wall into upper and lower chambers with a fridge formed in the lower chamber and a freezer formed in the upper chamber, and bottom mounted freezer (BMF) typed refrigerators in which a fridge is formed in the upper chamber and a freezer is formed in the lower chamber.

Furthermore, there may be side by side (SBS) typed refrigerators in which a storeroom is partitioned by a vertical partition wall into left and right chambers with a freezer formed in one chamber and a fridge formed in the other chamber, and French door refrigerator (FDR) typed refrigerators in which a storeroom is partitioned by a horizontal partition wall into upper and lower chambers with a fridge formed in the upper chamber and a freezer formed in the lower chamber.

In the FDR typed refrigerator, a pivot bar may be provided to prevent cool air leaks from where a pair of side-by-side doors meet. The pivot bar may be mounted on one of the pair of doors.

However, when the door with the pivot bar mounted thereon is strongly pulled open, it might strike or collide with the other door, causing damage and noise.

SUMMARY

The disclosure discloses a refrigerator with an enhanced door.

The disclosure also discloses a refrigerator that is capable of preventing generation of noise by having a pivot bar located in the right place when a door with the pivot bar mounted thereon is opened.

The disclosure also provides a refrigerator that is capable of preventing collision and damage of the pivot bar when a door is pulled open, thereby enhancing the quality.

According to an aspect of the disclosure, a refrigerator includes a main body including a storeroom; first and second doors pivotally coupled to the main body to open or close the storeroom; a pivot bar pivotally installed at the first door, and movable between a first position between the first and second doors and a second position pivoted toward the first door to prevent cold air leaks from the storeroom; and a locking device separably locking the pivot bar to the first door when the pivot bar is in the second position.

The locking device may include a first locking member arranged on at least one of the pivot bar and the first door and including a projection with a portion protruding, and a second locking member arranged on at least the other of the pivot bar and the first door and having a locking hole formed to correspond to the projection.

The second locking member may be provided to lock in or unlock the first locking member.

The projection may further include a stuck portion to be caught in the locking hole.

The second locking member may include rubber or silicon.

The locking hole may further include a guide hole formed to guide coupling of the projection.

The guide hole may be formed by extending from edges of the locking hole.

The first locking member may be installed in a first locking member installation part formed on at least one of the pivot bar and the first door, and at least a portion of the first locking member installation part may include a contact plane formed with an inclination to contact the second locking member.

The second locking member may include a locking body rotationally installed on at least one of the pivot bar and the first door and defining an exterior, and the locking hole may be formed on the front of the locking body, and a locking body fixer may be arranged on the back of the locking body to be installed on at least one of the pivot bar and the first door.

The contact plane may be formed at a first angle, and the second locking member may be arranged to be rotated within the first angle such that at least a portion of the front of the locking body comes into contact with the contact plane.

The locking hole of the second locking member may include elastic pieces formed to face each other to be engaged in coupling with the stuck portion, and the elastic pieces may have first thickness t1, which is smaller than thickness t of the locking body.

The locking body fixer may be installed in a second locking member installation part formed on at least one of the pivot bar and the first door, and the second locking member installation part may include a rotation guide to enable rotation of the locking body.

The rotation guide may include a supporting plane formed to be separated from the back of the locking body, and a supporting rib protruding from the supporting plane to support the center of the back of the locking body.

The pivot bar may be positioned in parallel with the first door when in the first position, and may be pivoted from the first position so that the first and second locking members are locked to each other when in the second position.

According to another aspect of the disclosure, a refrigerator includes a main body; and first and second doors pivotally coupled to the main body; a pivot bar pivotally installed at the first door; and a locking device separably locking the pivot bar to the first door when the first door is opened, wherein the locking device includes a first locking member arranged at the first door; and a second locking member arranged at the pivot bar to lock in or unlock the first locking member.

The first locking member may include a projection having at least a portion protrude, and a stuck portion formed by extending from the projection.

The second locking member may include a locking body defining an exterior, and the locking body may have a locking hole corresponding to the projection.

The locking hole may include a guide hole formed by extending vertically from the locking hole to guide coupling with the projection, and elastic pieces arranged to face each other on either side of the locking hole to be engaged in coupling with the stuck portion.

The first locking member may be installed in a first locking member installation part arranged at the first door, and at least a portion of the first locking member installation part may include a contact plane formed with an inclination to contact the second locking member.

The contact plane may be formed at a first angle, and the second locking member may be arranged to be rotated within the first angle such that at least a portion of the front of the locking body comes into contact with the contact plane.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
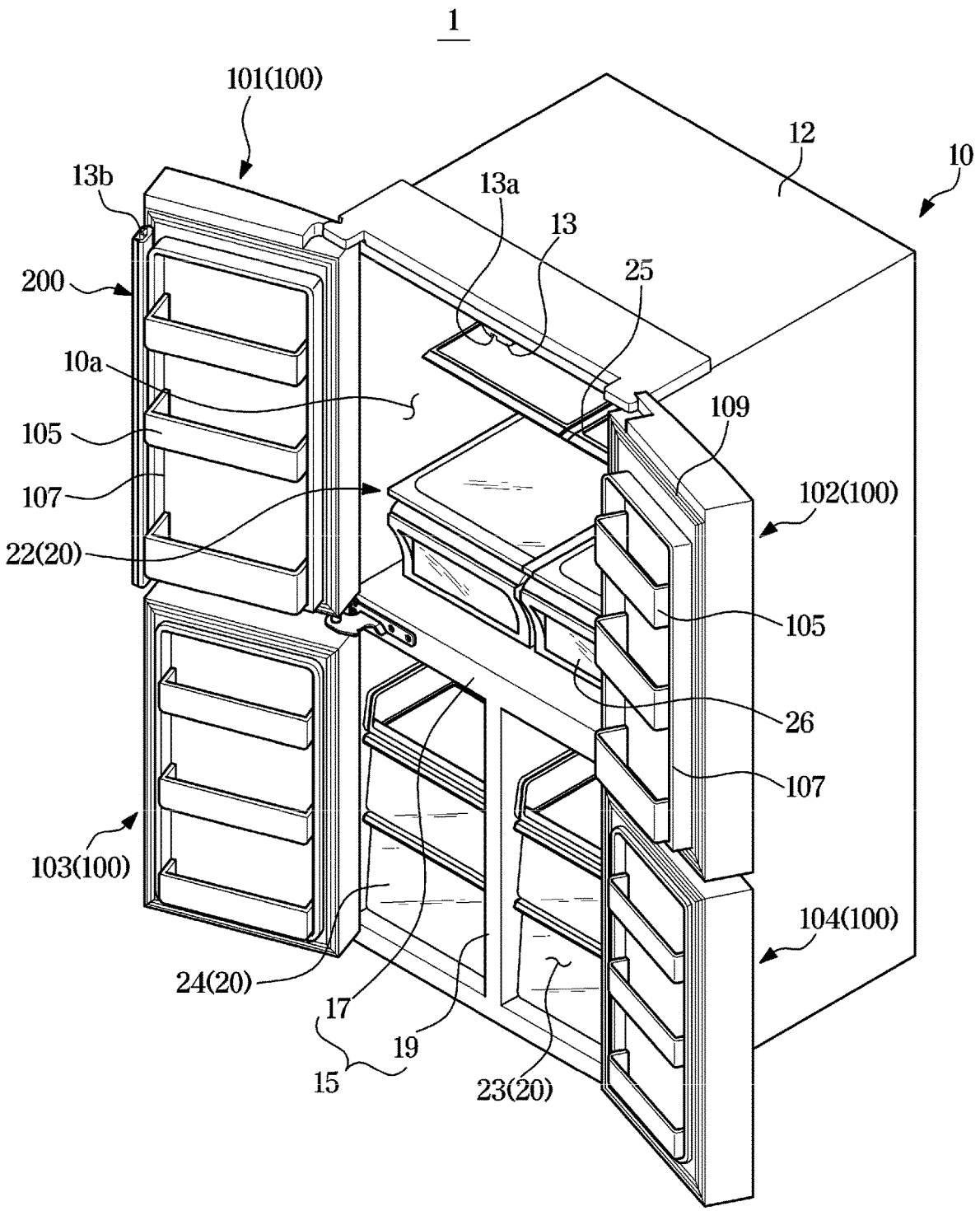
FIG. 1 is a perspective view of a refrigerator, according to an embodiment of the disclosure.

Embodiments and features as described and illustrated in the disclosure are merely examples, and there may be various modifications to the embodiments described below.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprise" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

Reference will now be made in detail to embodiments, examples of which are illustrated in the accompanying drawings, wherein like reference numerals refer to like elements throughout.

FIG. 1 is a perspective view of a refrigerator, according to an embodiment of the disclosure.

Referring to FIG. 1, a refrigerator 1 may include a main body 10, a storeroom 20 formed inside the main body 10 and partitioned into upper and lower chambers, a door 100 for opening or closing the storeroom 20, and a cold air supply device (not shown) for supplying cold air into the storeroom 20.

The main body 10 may include an inner case 10*a* that defines the storeroom 20, an outer case 12 combined on the outer side of the inner case 10*a* to define the exterior, and insulation (not shown) foamed between the inner case 10*a* and the outer case 12 for insulating the storeroom 20.

The cold air supply device may produce cold air by using a refrigeration cycle of compression, condensation, expansion and evaporation.

The storeroom 20 may be divided by a partition 15 into a plurality of chambers, and there may be a plurality of shelves 25 and containers 26 to store foods in the storeroom 20.

For example, the storeroom 20 may be divided by the partition 15 into the plurality of chambers 22, 23, and 24. The partition 15 may include a first partition 17 horizontally coupled to the inner side of the storeroom 20 to divide the storeroom 20 into an upper storeroom (or a first storeroom 22) and lower storerooms 23 and 24, and a second partition 19 vertically coupled to the lower storerooms 23 and 24 to divide them into a second storeroom 23 and a third storeroom 24.

The partition 15 with the first and second partitions 17 and 19 combined into a T shape, may divide the storeroom 20 into three chambers. Of the upper storeroom 22 and the lower storerooms 23 and 24 divided by the first partition 17, the upper storeroom 22 may be used as a fridge and the lower storerooms 23 and 24 may be used as a freezer.

Alternatively, the lower storerooms 23 and 24 may all be used as a freezer, or the second storeroom 23 may be used as a freezer while the third storeroom 24 is used as a fridge, or the second storeroom 23 is used as a freezer while the third storeroom 24 is used for both the freezer and the fridge.

Such division of the storeroom 20 is just an example, and the storerooms 22, 23 and 24 may be used differently from what are described above.

The storeroom 20 may be opened or closed by the door 100.

The door 100 may include a pair of upper doors 101 and 102, i.e., first and second doors to open or close the upper storeroom 22, and a pair of lower doors 103 and 104, i.e., third and fourth doors to open or close the lower storerooms 23 and 24.

The pair of upper doors 101 and 102 and the pair of lower doors 103 and 104 may open or close an opening 10*a* of the main body 10.

In the following description, for convenience of explanation, just the first door 101 will be described and descriptions of the other doors will be omitted. The second door 102 may have substantially the same structure as the first door 1 except for having mirror symmetry with the first door 101. A structure of the first door 101 may be equally applied to the second door 102, so the details of the second door 102 will not be described.

The upper storeroom 22 may be opened or closed by the first door 101 pivotally coupled to the main body 10. The first door 101 may be pulled open or closed with a first door handle (not shown).

The first door handle may be formed by being sunken to the bottom of the first door 101. Door shelves 105 may be arranged on the rear side of the first door 101 to contain foods. The door shelves 105 may include a shelf supporter 107 vertically extending from the first door 101 to support the door shelves 105 from both the left and right sides of the door shelves 105. The shelf supporter 107 may be a separate component which may be separably arranged on the first door 10, and in this embodiment of the disclosure, may protrude rearward from the rear side of the first door 101 and extend vertically. Shelf installation portions 107*a* (FIG. 2) may be formed on an inner side of the shelf supporter 107, at which to install the door shelves 105. The shelf installation portions 107*a* may be arranged at certain intervals.

A gasket 109 may be provided on the rear edges of the first door 101 to seal gaps with the main body 10 while the first door 101 is closed. The gasket 109 may be installed in a loop along the rear edges of the first door 101 and may include a first magnet (not shown).

A pivot bar 200 may be arranged at one of the pair of upper doors 101 and 102. The pivot bar 200 may be pivotally installed at one of the pair of upper doors 101 and 102 to seal the gap between the pair of doors 101 whenever the door 101 is pulled open or closed. Although the embodiment of the disclosure shows the pivot bar 200 installed at the first door 101, the disclosure is not limited thereto. For example, the pivot bar 200 may be installed at the second door 102.

A pivot bar guide 13 may be arranged at the main body 10 to guide movement of the pivot bar 200. A guide groove 13*a* may be formed at the pivot bar guide 13. A guide projection 13*b* may be formed at the pivot bar 200 to match the guide groove 13*a*. The guide projection 13*b* may be formed at the top of the pivot bar 200, and may move and rotate along the groove 13*a* of the pivot bar guide 13 while being inserted to the guide groove 13*a* when the door 101 is pulled open or closed. The guide projection 13*b* installed at the pivot bar 200 may be elastically supported by an elastic member (not shown) to be able to move vertically.

Figure 2:
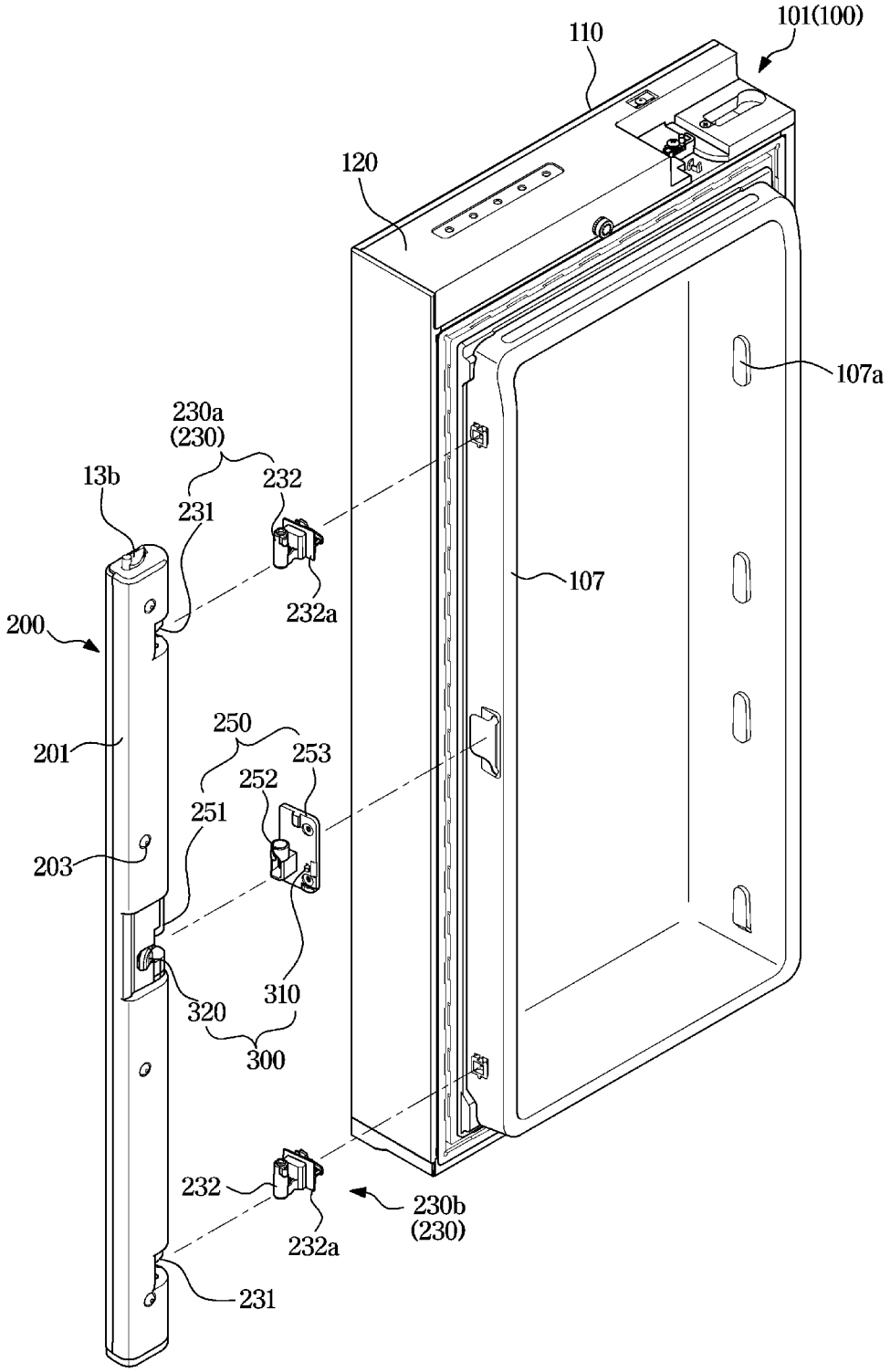
FIG. 2 is a perspective view of a pivot bar installed at a door of a refrigerator, according to an embodiment of the disclosure.
Figure 3:
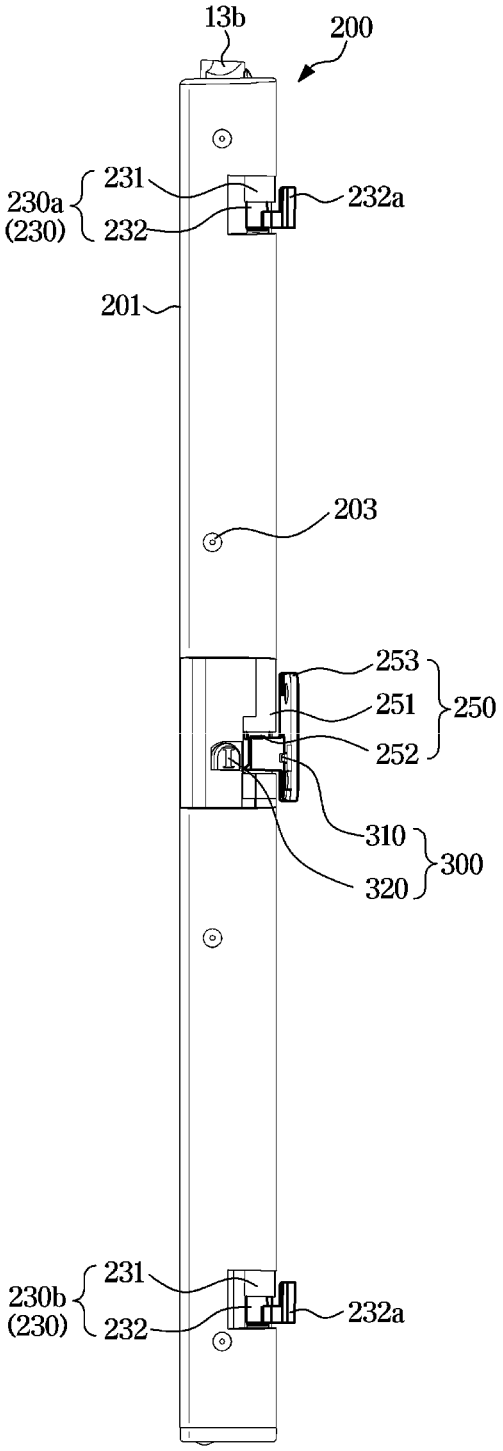
FIG. 3 shows a pivot bar with a locking device installed thereon, according to an embodiment of the disclosure.
Figure 4:
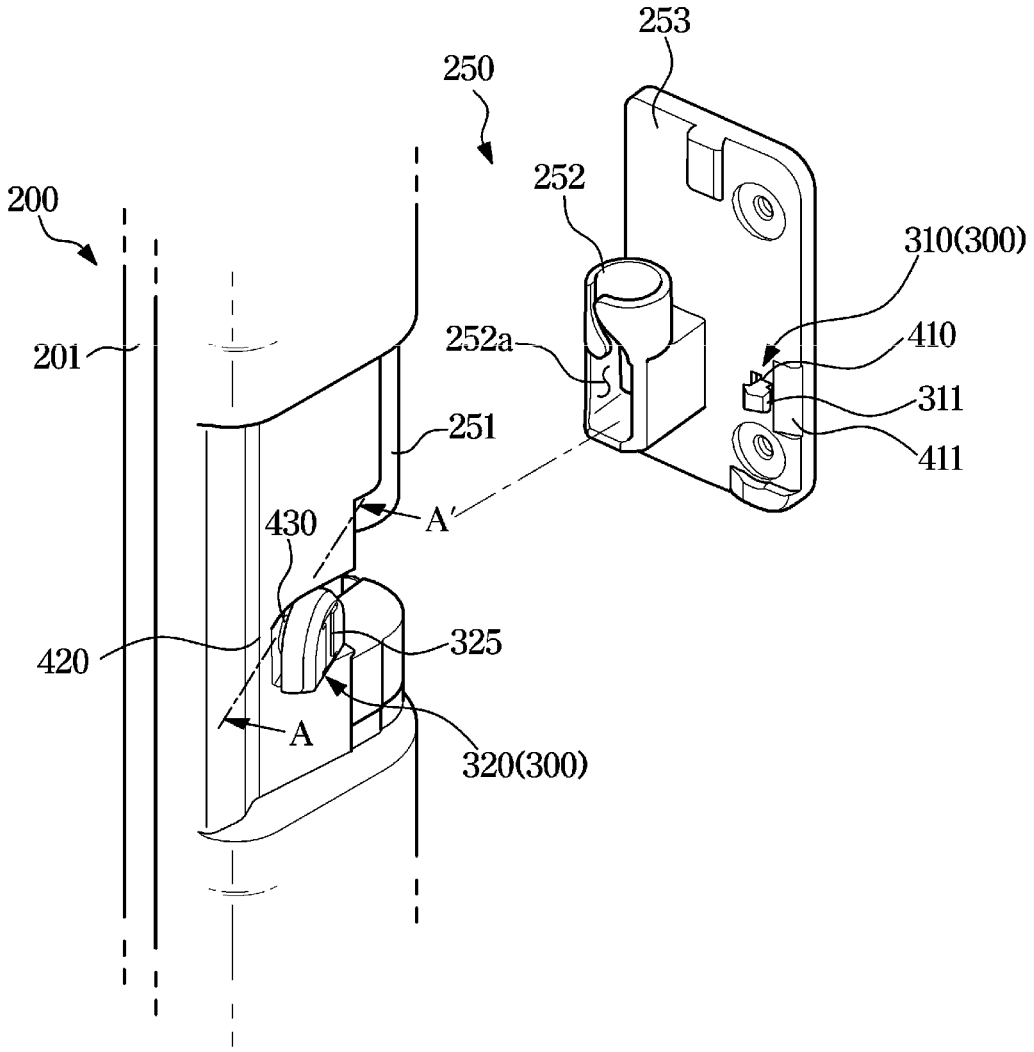
FIG. 4 shows first and second locking members of a locking device, according to an embodiment of the disclosure.

FIG. 2 is a perspective view of a pivot bar installed at a door of a refrigerator, according to an embodiment of the disclosure, FIG. 3 shows a pivot bar with a locking device installed thereon, according to an embodiment of the disclosure, and FIG. 4 shows first and second locking members in a locking device, according to an embodiment of the disclosure.

Referring to FIGS. 2 to 4, the pivot bar 200 may be arranged at one of the pair of doors 101 and 102. The pivot bar 200 may be provided to seal the gap between the pair of doors 101 while the pair of doors 101 are closed.

The door 101 may include a door panel 110 and a door body 120. The door panel 110 may be separably coupled to the door body 120. The door shelves 105 for containing foods and the shelf supporter 107 provided to install the door shelves 105 may be arranged on the rear side of the door body 120.

The pivot bar 200 may be pivotally installed at the first door 101 (hereinafter, just referred to as a door 101). The pivot bar 200 may have the form of a vertically long bar. The pivot bar 200 may include a pivot bar body 201 that defines the exterior. An insulation member (see FIG. 8) may fill the inside of the pivot bar body 201. An anti-shock part 203 may be arranged at the pivot bar 200 to prevent shock with the door 101 when the pivot bar 200 is pivoted. The anti-shock part 203 may include a plurality of elastic members. There are four elastic members, for example, in the embodiment of the disclosure, but the disclosure is not limited thereto.

The pivot bar 200 may be installed to be able to pivot on a hinge device 230. The hinge device 230 may be installed on one side of the pivot bar body 201. The hinge device 230 is a device to connect between the pivot bar 200 and the door 102 such that the pivot bar 200 may be pivoted thereon, and may include a first hinge 230*a* for connection of the upper portion and a second hinge 230*b* for connection of the lower portion. There are two hinge devices shown in the embodiment of the disclosure for example, but the disclosure is not limited thereto. For example, the number of hinge devices may vary depending on the size of the door or pivot bar.

A cable connector 250 may be arranged between the first and second hinges 230*a* and 230*b* for connecting between the pivot bar 200 and the door 101. The cable connector 250 may include a first connector 251 formed at the pivot bar 200 and a second connector 252 to be installed at the door 101. The first connector 251 may be formed integrally with the pivot bar body 201 of the pivot bar 200. The first connector 251 is formed for a cable (not shown) to be connected inside the pivot bar body 201. The second connector 252 may have a shape corresponding to and matching the first connector 251. The second connector 252 may be installed at the door 101 by means of a coupling bracket 253. The second connector 252 may include a through hole 252*a* for the cable to pass through.

In the following description, for convenience of explanation, just the first hinge 230*a* that connects the pivot bar 200 to the upper portion of the door 101 will be focused.

The first hinge 230*a* may include a hinge shaft 232*a* and a hinge shaft coupler 231 pivotally supported by the hinge shaft 232*a*. The hinge shaft 232 may be formed on a hinge shaft bracket 232*a*. The hinge shaft bracket 232*a* may be coupled to the hinge shaft coupler 231 of the pivot bar 200 and then to the door 101. The pivot bar 200 may be pivotally coupled to the door 101 by means of the hinge shaft bracket 232*a*. The hinge bracket 232*a* may be installed on at least one side of the shelf supporter 107 of the door 101. The hinge bracket 232*a* may be installed on an outer side of the shelf supporter 107. Although the pivot bar 200 is pivotally mounted on the door 101 with the hinge shaft coupler 231 being arranged on the pivot bar 200 and the hinge shaft 232 being mounted on the door 101 in the embodiment of the disclosure, the disclosure is not limited thereto. For example, where to install the hinge shaft and hinge shaft coupler may vary.

The pivot bar 200 may be pivotally installed at the door 101 by means of the hinge device 230.

The pivot bar 200 may be installed to pivot when the door 101 is pulled open or closed. The pivot bar 200 is in a first position P1 (see FIG. 8) where the pivot bar 200 is located horizontally parallel to the door 101 while the door 101 is closed. The pivot bar 200 is in a second position P2 (see FIG. 9) pivoted from the first position P1 while the door 1 is opened.

In this case, a locking device 300 may be included to separably connect between the pivot bar 200 and the door 101 in order to stably put the pivot bar 200 in the second position P2.

The locking device 300 may be arranged to lock or unlock the pivot bar 200 into or out of the door 101. The locking device 300 may be provided to prevent the pivot bar 200 that might be unlocked out of the door 101 when the user vigorously pulls the door 101 open or closed from colliding with another door 101 that is in the closed state.

The door 101 is opened while the pivot bar 200 is locked into the door 101 with the locking device 300, and thus the pivot bar 200 may not collide with the other door 101 that is in the closed state, because the pivot bar 200 is not separated from the door 101 even with the shock of the door 101 being vigorously pulled open by the user.

The locking device 300 may include a first locking member 310 arranged at one of the pivot bar 200 and the door 101, and a second locking member 320 arranged at the other of the pivot bar 200 and the door 101 to be locked with or unlocked from the first locking member 310. For example, the first locking member 310 may be arranged at the door 101. The first locking member 310 may be arranged on the shelf supporter 107 of the door 101. The first locking member 310 may be arranged in a first locking member installation part 410. Although the embodiment of the disclosure shows the first locking member installation part 410 being formed at the coupling bracket 253, the disclosure is not limited thereto. For example, the first locking member installation part may be formed at a different position on the door.

The first locking member installation part 410 may further include a contact plane 411 formed to contact at least a part of the second locking member 320 when the pivot bar 200 is pivoted. The contact plane 411 may be formed with an inclination to contact the at least a part of the second locking member 320. The contact plane 411 may have the inclination of a first angle θ1. The contact plane 411 may be formed on at least a side to the first locking member 310. The contact plane 411 may be formed on the outer side to the first locking member 310.

The first locking member 310 may include a projection 311. The top end of the projection 311 may include stuck portions 312 extending farther out than the projection 311 to be stuck in a locking hole 325 of the second locking member 320, which will be described later.

The second locking member 320 may be arranged at the pivot bar 200. The second locking member 320 may be installed at the pivot bar 200. The second locking member 320 may be arranged in a second locking member installation part 420. The second locking member installation part 420 may be formed to be sunken into at least one side of the pivot bar 200. The second locking member installation part 420 may be formed at a position corresponding to the first locking member installation part 410.

The second locking member 320 may be provided to lock or unlock the first locking member 310. The second locking member 320 may be provided to lock or unlock the projection 311 of the first locking member 310.

Figure 5:
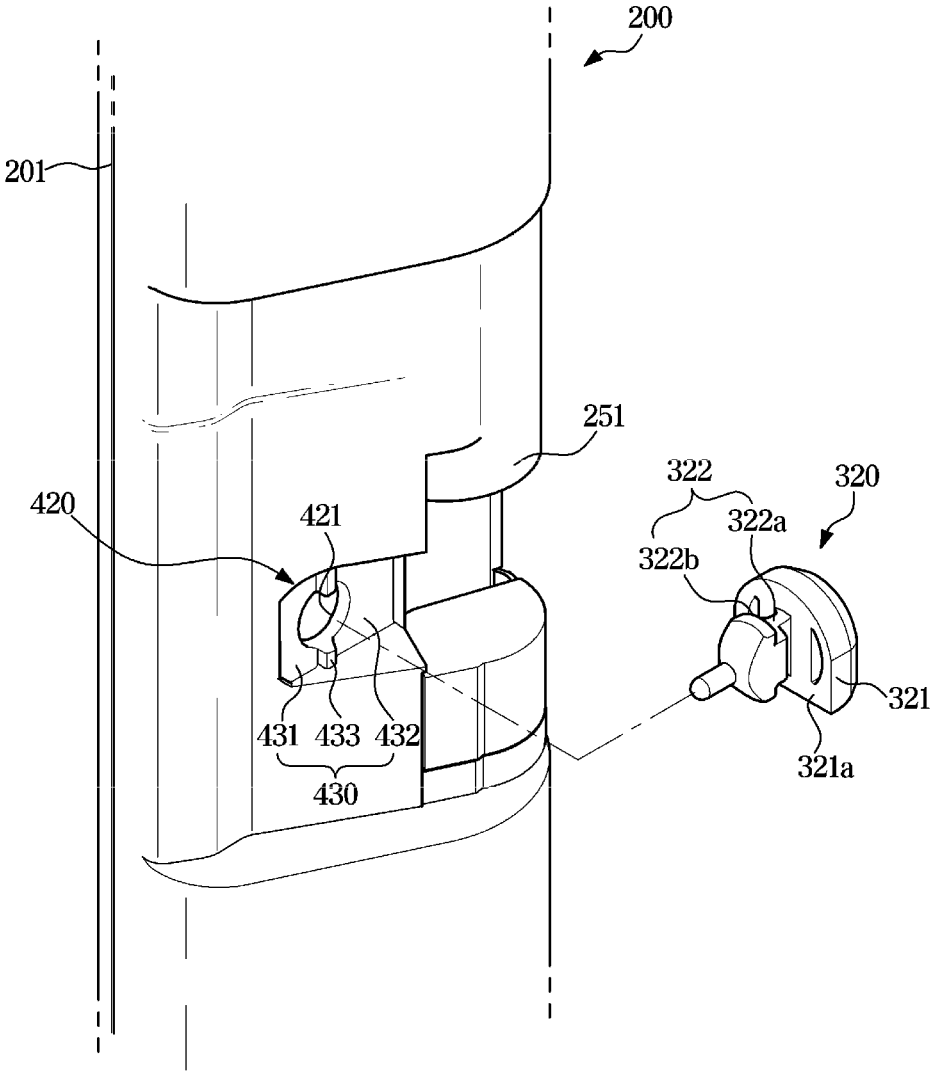
FIG. 5 shows a second locking member being installed onto a pivot bar, according to an embodiment of the disclosure.
Figure 6:
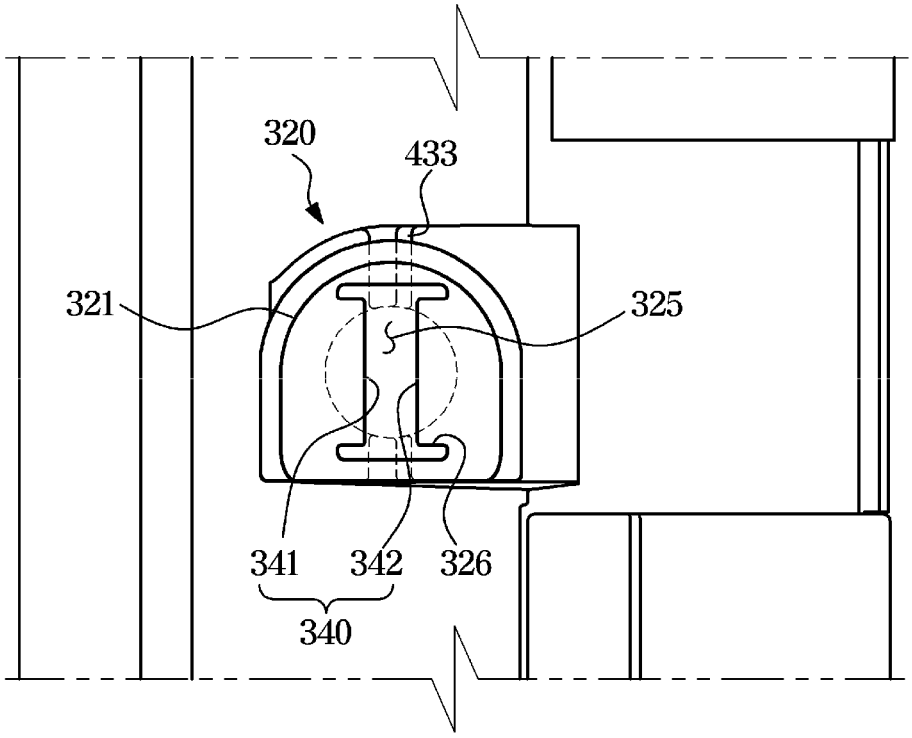
FIG. 6 shows a second locking member installed at a pivot bar, according to an embodiment of the disclosure.
Figure 7:
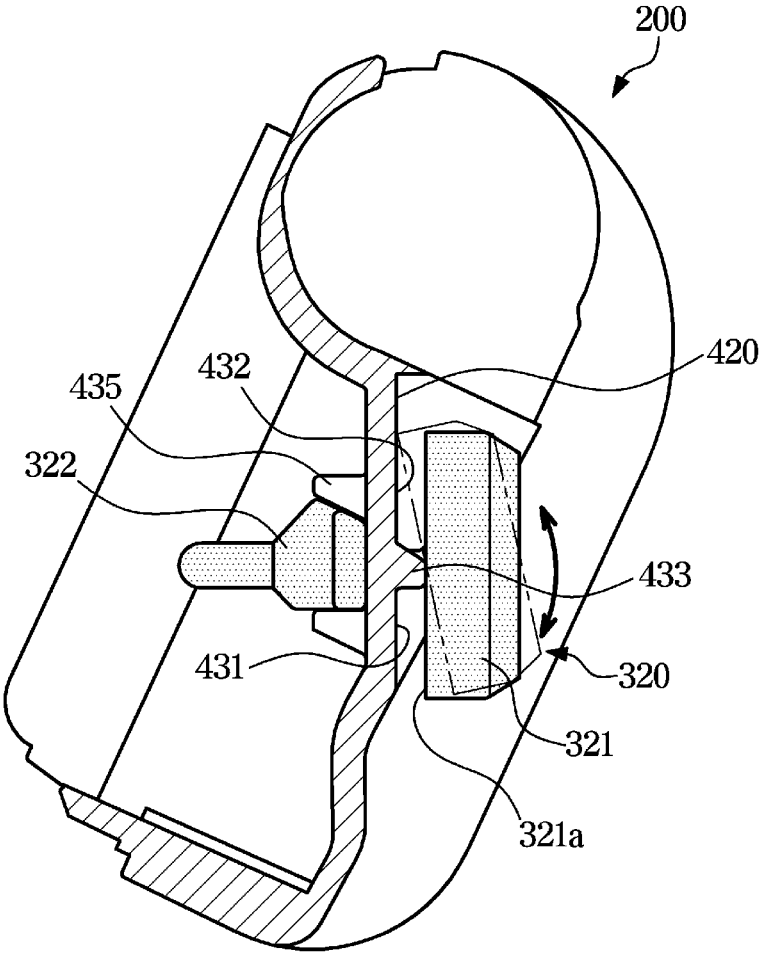
FIG. 7 is a cross-sectional view along line A-A' of FIG. 4 to illustrate operation of the second locking member installed in a rotation guide of the pivot bar, according to an embodiment of the disclosure.

FIG. 5 shows a second locking member being installed at a pivot bar, according to an embodiment of the disclosure, FIG. 6 shows a second locking member installed at a pivot bar, according to an embodiment of the disclosure, and FIG. 7 is a cross-sectional view along line A-A' of FIG. 4 to illustrate operation of the second locking member installed in a rotation guide of the pivot bar, according to an embodiment of the disclosure.

Referring to FIGS. 5 to 7, the second locking member 320 of the locking device 300 may be installed in the second locking member installation part 420 of the pivot bar 200.

The second locking member installation part 420 may be located in the middle of the pivot bar 200. The second locking member installation part 420 may be formed at a position corresponding to the first locking member installation part 410. The second locking member installation part 420 may include a second locking member through hole 421 for at least a portion of the second locking member 320 to be inserted to. The second locking member through hole 421 may be formed in a size and shape corresponding to the second locking member 320.

The second locking member 320 may be formed to include rubber or silicon. The second locking member 320 may be formed of a soft material.

The second locking member 320 may include a locking body 321 that defines the exterior.

The second locking member 320 may include a locking hole 325 and a locking body fixer 322. The locking hole 325 may be formed on the front of the locking body 321. The locking body fixer 322 may be arranged on the back of the locking body 321. The locking body fixer 322 may protrude rearward from the locking body 321. The locking body fixer 322 may include a first fixer 322*a* and a second fixer 322*b*. The first fixer 322*a* of the locking body fixer 322 may be formed in a size and shape corresponding to the second locking member through hole 421. The second fixer 322*b* of the locking body fixer 322 may protrude outward by extending rearward from the first fixer 322*a*.

A fixing rib 435 may be arranged on the rear side of the second locking member installation part 420 to support the locking body fixer 322. The fixing rib 435 may support at least a side of the locking body fixer 322 to prevent movement of the second locking member 320. The fixing rib 435 may be arranged to support the second fixer 322*b* of the locking body fixer 322.

The locking body fixer 322 may be fixed by being inserted through the second locking member through hole 421.

The second locking member 320 may be rotationally installed in the second locking member installation part 420.

The second locking member installation part 420 may further include a rotation guide 430 for rotationally supporting the locking body 321 of the second locking member 320. The rotation guide 430 may include rotation supporting planes 431 and 432 formed on either side of the second locking member through hole 421 of the second locking member installation part 420 and supporting ribs 433 formed in the center of the rotation supporting planes 431 and 432.

The rotation supporting planes 431 and 432 of the rotation guide 430 may be formed at a distance from the rear side of the locking body 321 of the second locking member 320. The supporting ribs 433 may be arranged at upper and lower portions of the second locking member through hole 421. The supporting ribs 433 may be arranged to support the center of the locking body 321. The locking body 321 may be rotated to the left or right from the supporting ribs 433. The second locking member 320 may be rotated to the left or right from the supporting ribs 433. Such left and right rotation of the second locking member 320 may prevent wrong combination of the first and second locking members 310 and 320. The rotation guide 430 may guide combination of the second locking member 320 with the first locking member 310 by enabling changes in position of the second locking member 320, thereby preventing wrong combination between the first and second locking members 310 and 320.

The locking hole 325 of the second locking member 320 may be formed in a shape corresponding to the projection 311 of the first locking member 310. The locking hole 325 may be formed for the projection 311 of the first locking member 310 to be inserted thereto to be locked or unlocked. The locking hole 325 may be formed for the projection 311 of the first locking member 310 to be inserted thereto.

The locking hole 325 may include elastic pieces 340 to be engaged in coupling with the stuck portions 312 of the first locking member 310. The elastic pieces 340 may be formed to face each other on either side of the locking hole 325. The elastic pieces 340 may include a first elastic piece 341 arranged on one side of the locking hole 325 and a second elastic piece 342 arranged on the other side of the locking hole 325. The elastic pieces 341 and 342 may be provided to lock in the stuck portions 312 of the projection 311.

The elastic pieces 340 may be arranged in a position corresponding to the stuck portions 312 of the first locking member 310. The elastic pieces 340 may be formed with free ends to lock in or unlock the stuck portions 312 of the first locking member 310. The elastic pieces 340 may have first thickness t1 (see FIG. 10). The first thickness t1 of the elastic pieces 340 may be smaller than thickness t of the second locking member 320. The first thickness t1 of the elastic pieces 340 may be smaller than thickness t of the locking body 321.

The locking hole 325 may further include a guide hole 326 formed to guide coupling of the projection 311 of the first locking member 310. The guide hole 326 may be formed by extending upward and downward from the locking hole 325. The guide hole 326 may be formed by extending upward and downward from the upper and lower ends of the locking hole 325. The guide hole 326 formed by extending from the locking hole 325 may correspond to various positions of the projection 311 of the first locking member 310 when the position of the projection 311 varies. Although the embodiment of the disclosure shows that the guide hole 326 is formed by integrally extending from the locking hole 325, the disclosure is not limited thereto.

Figure 8:
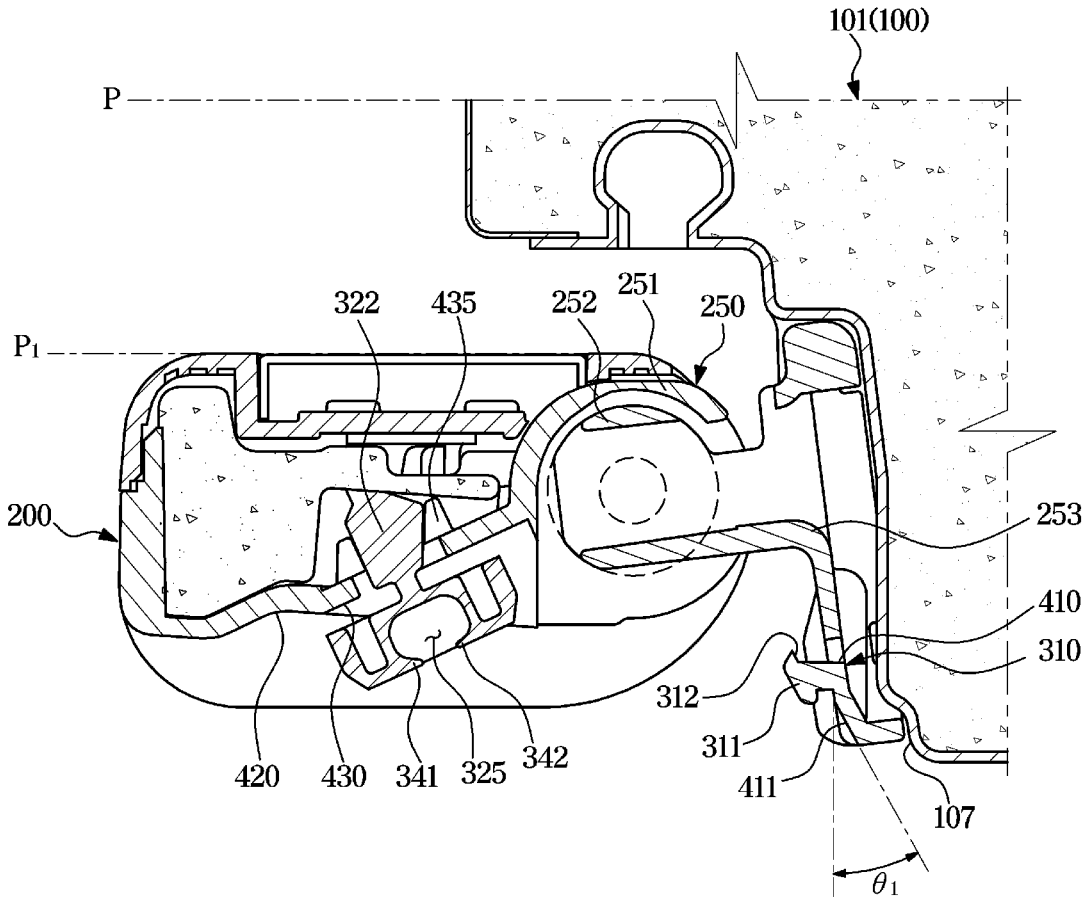
FIG. 8 is a cross-sectional view illustrating first and second locking members, according to an embodiment of the disclosure.
Figure 9:
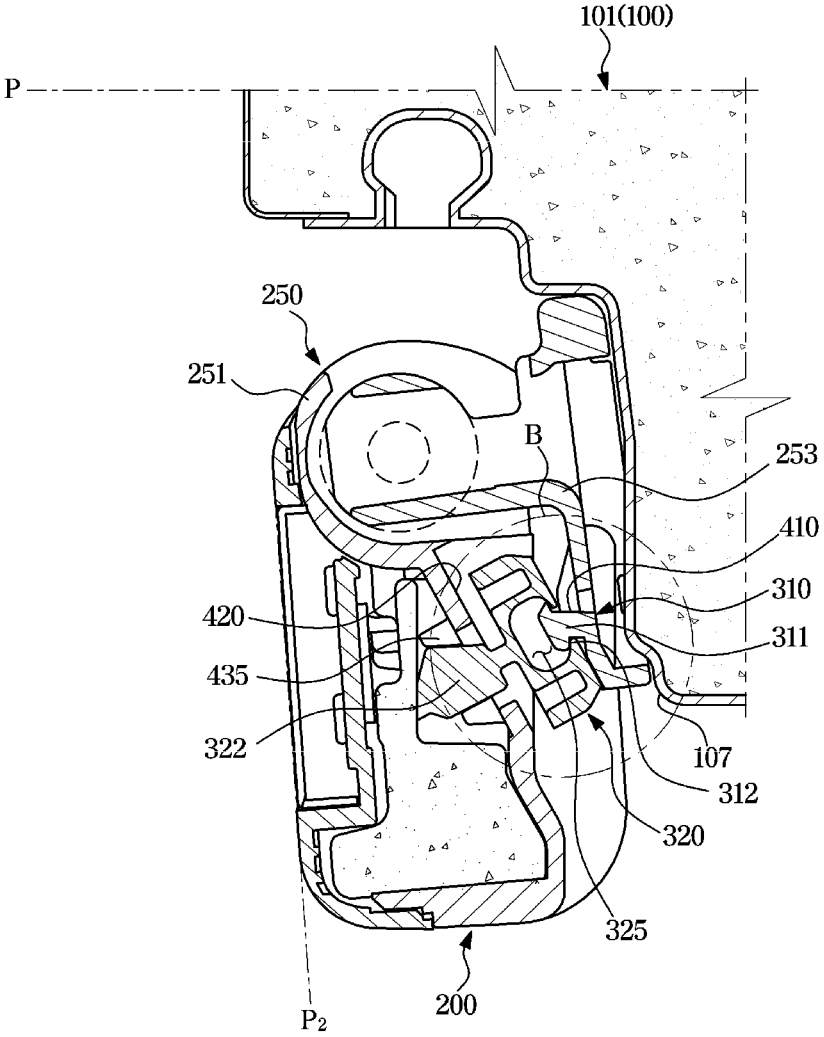
FIG. 9 shows first and second locking members combined together, according to an embodiment of the disclosure.
Figure 10:
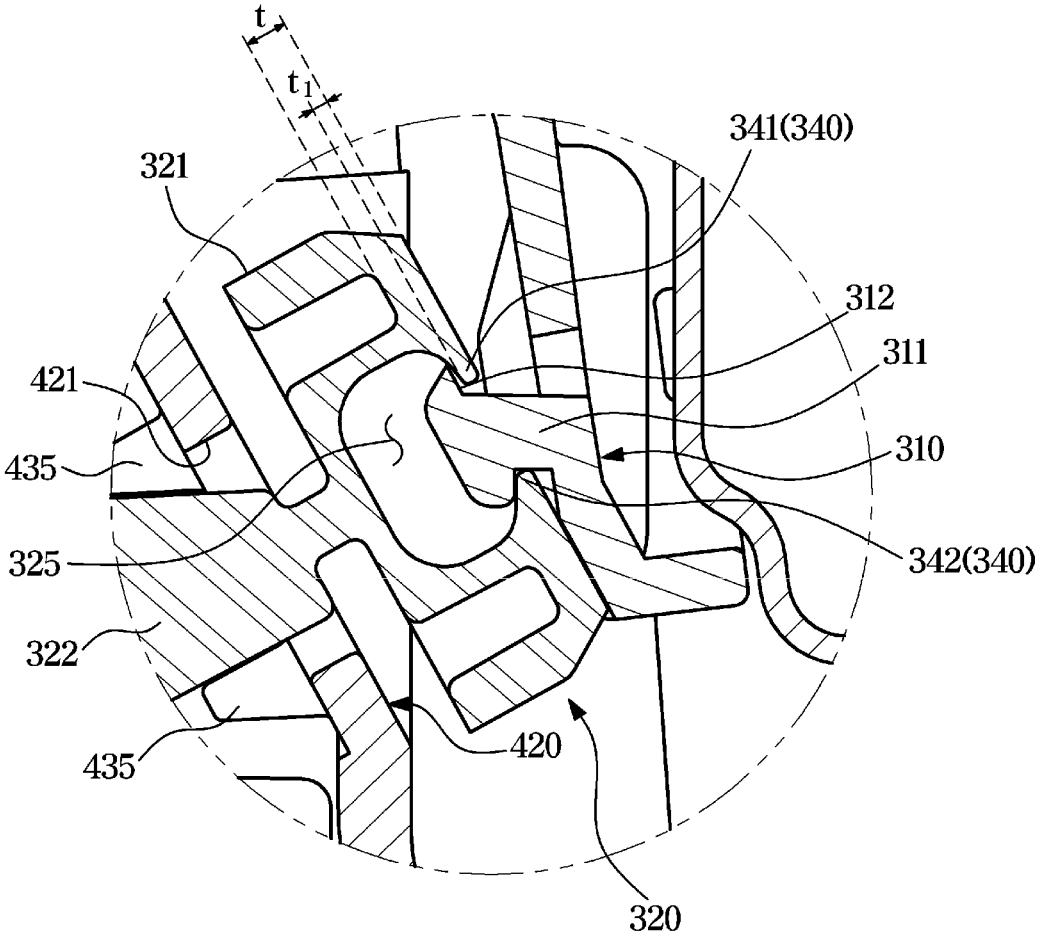
FIG. 10 is an enlarged view of portion B of FIG. 9 to illustrate a locked state of first and second locking members, according to an embodiment of the disclosure.

FIG. 8 is a cross-sectional view illustrating first and second locking members, according to an embodiment of the disclosure, FIG. 9 shows first and second locking members combined together, according to an embodiment of the disclosure, and FIG. 10 is an enlarged view of portion B of FIG. 9 to illustrate a locked state of first and second locking members, according to an embodiment of the disclosure.

Operation of the pivot bar 200 and the locking device 300 in closed and open states of the door 101 will now be described with reference to FIGS. 8 to 10.

In the closed state of the door 101, the pivot bar 200 is in the first position P1, which is parallel to the door 101. Specifically, the first position P1 of the pivot bar 200 is horizontally parallel to the position P1 of the door panel 110 of the door 101.

The first locking member 310 of the locking device 300 is arranged on the door 101. The projection 311 of the first locking member 310 is formed in and protrude from the first locking member installation part 410 of the door 101.

The first locking member installation part 410 may be provided with the contact plane 411 formed at an inclination of first angle θ1. The contact plane 411 may be arranged on the outer side to the projection 311.

The second locking member 320 may be arranged in the second locking member installation part 420 of the pivot bar 200. The second locking member 320 may be installed to rotate to the left or right by means of the rotation guide 430 formed in the second locking member installation part 420.

While the door 101 is opened, the pivot bar 200 is pivoted from the first position P1 to the second position P2 where the first and second locking members 310 and 320 are locked to each other.

The locking body 321 of the second locking member 320 has the locking hole 325 formed on the front, and when the projection 311 of the first locking member 310 is inserted to the locking hole 325, the first and second locking members 310 and 320 are locked to each other.

A portion of the front of the second locking member 320 may come into contact with the contact plane 411 of the first locking member installation part 410.

The pivot bar 200 may be further pivoted in the second position P2 as much as the first angle θ1 of the contact plane 411.

In the meantime, the first locking device 300 may vary in position depending on the weight of the door 101. Specifically, the projection 311 of the first locking device 300 may vary in position depending on the weight of foods put on the door shelves 105 of the door 101.

In this case, the locking body 321 of the second locking member 320 may be rotated to the left or right by the rotation guide 430 until matching the varying position of the first locking member 310.

Furthermore, the locking hole 325 of the second locking member 320 may include the guide hole 326 extending vertically from the locking hole 325, and the guide hole 326 may help the locking hole 325 match the vertically varying position of the projection 311 of the first locking member 310.

Such a locking hole 325 formed in the vertical direction of the second locking member 320 and rotated to the left or right by the rotation guide 430 may prevent wrong combination with the first locking member 310 and enable matching and combining with the first locking member 310 even with a minute change in position of the projection 311 of the first locking member 310.

Figure 11:
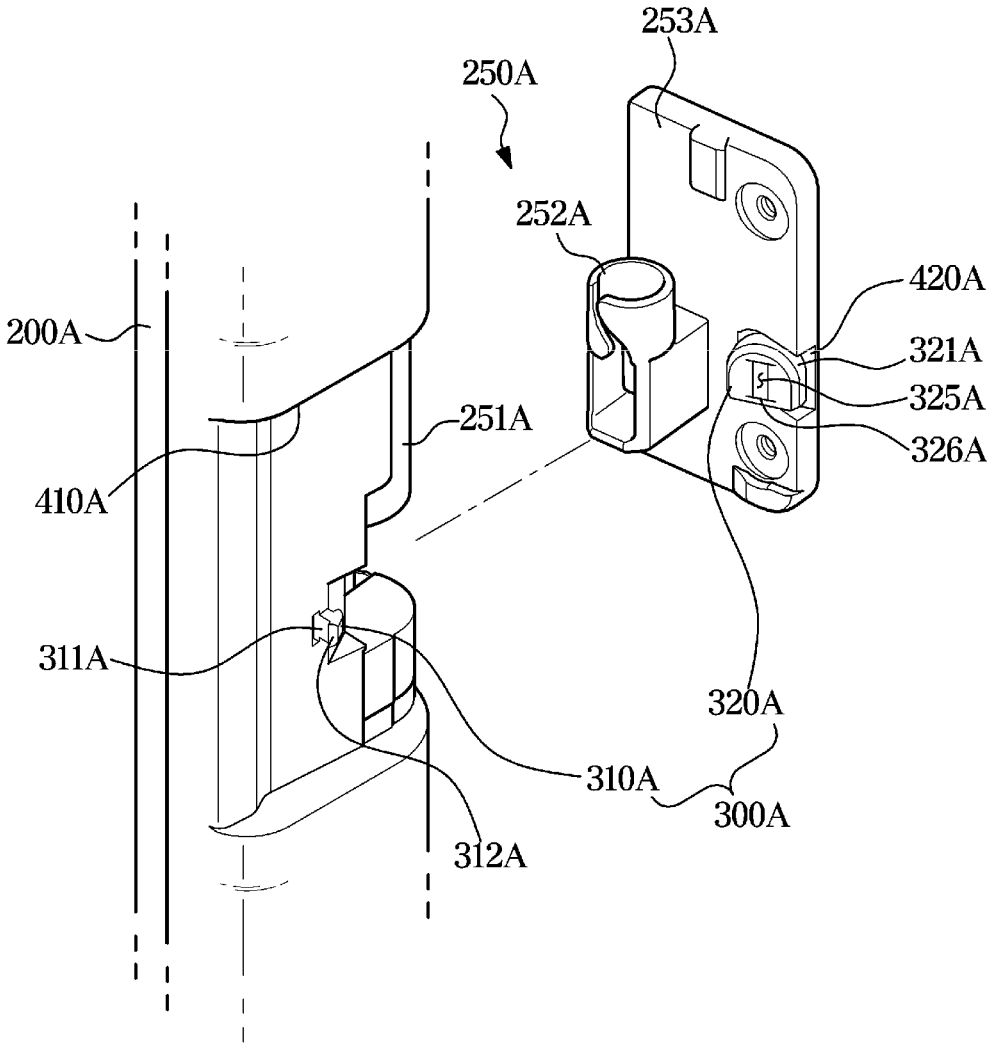
FIG. 11 shows first and second locking members of a locking device, according to another embodiment of the disclosure.

FIG. 11 shows first and second locking members of a locking device, according to another embodiment of the disclosure. Reference numerals not shown in FIG. 11 may be referred to from FIGS. 1 to 10.

Referring to FIG. 11, a locking device 300A may include a first locking member 310A and a second locking member 320A.

The locking device 300A may be provided for locking or unlocking between a door 101A and a pivot bar 200A. The locking device 300A may be provided to prevent the pivot bar 200A that might be unlocked out of the door 101A when the user vigorously pulls the door 101A open or closed from colliding with another door 101A that is in the closed state.

The first locking member 310A may be arranged on the pivot bar 200A and the second locking member 320A may be arranged on the door 101A.

The pivot bar 200A may also include a first locking member installation part 410A for the first locking member 310A to be installed therein. The door 101A may also include a second locking member installation part 420A for the second locking member 320A to be installed therein. A cable connector 250A may be provided for the door 101A. The cable connector 250A may include a first connector 251A formed at the pivot bar 200A, and a coupling bracket 253A having a second connector 252A formed to be connected to the first connector 251A. Although the embodiment of the disclosure shows the second locking member installation part 420A being formed at the coupling bracket 253A, the disclosure is not limited thereto.

The second locking member 320A installed at the door 101A may have an inclination of the first angle θ1, and may be installed to rotate to the left or right by means of a rotation guide 430 formed in the second locking member installation part 420A.

The second locking member 320A may include a locking hole 325A matching a projection 311A of the first locking member 310A. The locking hole 325A may be formed to be locked or unlocked when the projection 311A of the first locking member 310A is inserted thereto. The locking hole 325A may be formed for the first locking member 310A to be inserted thereto. The locking hole 325A may further include a guide hole 326A formed to guide coupling of the projection 311A of the first locking member 310A. The guide hole 326A may be formed by extending upward and downward from the locking hole 325A. The guide hole 326A may be formed by cutting upward and downward from the upper and lower ends of the locking hole 325A.

The guide hole 326A formed by extending from the locking hole 325A of the second locking member 320A may correspond to various changes in position of the projection 311A and locking hole 325A when the position of the projection 311A of the first locking member 310A is changed or the position of the second locking member 320A is changed by the door 101A.

The structure and operation of the refrigerator door 101A with the locking device A installed therein as described above may be fully understood from the above description, so the overlapping description will be omitted.

According to embodiments of the disclosure, a refrigerator may have a door with such an enhanced structure that has a pivot bar located in a right place when a door with the pivot bar installed thereon is opened, thereby preventing collision and damage of the pivot bar.

Furthermore, the refrigerator may have enhanced quality by reducing noise generated when the door is opened.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. A refrigerator comprising:

a main body including a storeroom;

first and second doors coupled to the main body to open or close the storeroom;

a pivot bar coupled to the first door, and movable between a first position between the first and second doors and a second position adjacent the first door, to reduce cold air leaks from the storeroom; and a lock configured to lock the pivot bar in the second position when the pivot bar is in the second position, the lock comprising:

a first locking member coupled to at least one of the pivot bar and the first door and including a projection protruding from the first locking member, and a second locking member coupled to at least the other of the pivot bar and the first door, the second locking member comprising a locking body rotationally coupled to at least one of the pivot bar and the first door and defining an exterior, and having a locking hole configured to receive the projection of the first locking member, and the locking hole being on a front of the locking body, and a locking body fixer being arranged on the back of the locking body which is rotationally coupled to the at least one of the pivot bar and the first door, at least one of the pivot bar or the first door being provided with a first locking member installation part on which the first locking member is allowed to be installed, at least another one of the pivot bar or the first door being provided with a second locking member installation part on which the second locking member is allowed to be installed, at least a portion of the first locking member installation part being provided with a contact surface that is inclined to come in contact with the second locking member, and the second locking member installation part including a rotation guide formed to be inclined to enable at least a portion of the second locking member to rotate.

2. The refrigerator of claim 1, wherein the projection further comprises a stuck portion protruding further outward than the projection to be locked with the locking hole.

3. The refrigerator of claim 1, wherein the contact surface is provided on one side of the first locking member.

4. The refrigerator of claim 3, wherein the contact surface is disposed on an outer side of the projection.

5. The refrigerator of claim 1, wherein the contact plane is positioned at a first angle, and wherein the second locking member is arranged to be rotated within the first angle such that at least a portion of the front of the locking body comes into contact with the contact plane.

6. The refrigerator of claim 1, wherein the second locking member installation part includes a second locking member through hole formed to allow at least a portion of the second locking member to be inserted thereinto, and the second locking member through hole further includes a fixing rib provided to support the locking body fixer.

7. The refrigerator of claim 5, wherein the rotation guide includes a support plane configured to be spaced apart from a bottom surface of the locking body, and a support rib protruding from the support plane toward the locking body to support a center of a rear surface of the locking body.

8. The refrigerator of claim 5, wherein the support plane is formed at a first angle.

9. The refrigerator of claim 6, wherein the locking body fixer protrudes toward a rear of the locking body, and includes a first fixer corresponding to the second locking body through hole and a second fixer extending from the first fixer while protruding outside.

10. The refrigerator of claim 1, wherein the second locking member comprises rubber or silicon.

11. The refrigerator of claim 1, wherein the locking hole further comprises a guide hole configured to guide coupling of the projection.

12. The refrigerator of claim 9, wherein the guide hole extends from edges of the locking hole.

13. The refrigerator of claim 3, wherein the locking hole of the second locking member comprises elastic pieces configured to face each other to be engaged in coupling with the stuck portion of the projection, and wherein the elastic pieces have a first thickness t1, which is smaller than a thickness t of the locking body.

14. The refrigerator of claim 1, wherein the pivot bar is positioned in parallel with the first door in the first position, and is configured to be pivoted from the first position so that the first and second locking members are locked to each other in the second position.

* * * * *